United States Patent [19]

Maitland et al.

[11] 4,058,677

[45] Nov. 15, 1977

[54] SOUND SCRAMBLING EQUIPMENT

[75] Inventors: Peter Maitland, Fort Lauderdale, Fla.; William H. Draeger, Corona, Calif.

[73] Assignee: Lear Siegler, Inc., Santa Monica, Calif.

[21] Appl. No.: 600,133

[22] Filed: July 30, 1975

Related U.S. Application Data

[63] Continuation-in-part of Ser. No. 464,365, April 26, 1974, abandoned.

[51] Int. Cl.[2] ..... H04K 1/04

[52] U.S. Cl. ..... 179/1.5 FS; 179/1.5 R; 179/1.5 S

[58] Field of Search ..... 179/1.5 R, 1.5 FS, 5; 325/32, 33

[56] References Cited

U.S. PATENT DOCUMENTS

| | | | |
|---|---|---|---|
| 2,411,206 | 11/1946 | Guanella | 179/1.5 R |
| 2,509,716 | 5/1950 | Aubert | 325/33 |
| 2,510,338 | 6/1950 | Guanella | 179/1.5 R |
| 3,155,908 | 11/1964 | Berman | 179/1.5 R |
| 3,696,207 | 10/1972 | Lundin et al. | 179/1.5 R |

*Primary Examiner*—Howard A. Birmiel
*Attorney, Agent, or Firm*—Christie, Parker & Hale

[57] ABSTRACT

Intelligence, such as voice signals, is scrambled for secrecy communication by translating the frequency spectrum of the intelligence by mixing the signals within the frequency spectrum with a local oscillator signal having a frequency that varies between a plurality of discrete frequencies at a selected rate. The translated spectrum is split into two or more channels, and the scrambled intelligence having a frequency spectrum above a selected value is passed through a first channel wherein the frequency spectrum of the signals is reduced to a frequency spectrum at the lower end of the spectrum of the unscrambled intelligence that is not being used by the translated intelligence. The entire frequency spectrum of the translated intelligence is passed through a second channel and the output of each channel is combined and the bandwidth thereof is limited to a selected bandwidth.

In a complete communication system the scrambled intelligence is unscrambled by translating the frequency spectrum of the scrambled intelligence by mixing the signals within the frequency spectrum of the scrambled intelligence with a local oscillator signal having frequencies that vary between a plurality of discrete frequencies at a selected rate in synchronism with the local oscillator signal of the scrambler unit. The translated scrambled input is passed through two or more channels with the signals above a selected frequency level being passed through a first channel wherein the frequency spectrum of the scrambled intelligence is reduced to the frequency spectrum at the lower end of the frequency spectrum of the unscrambled intelligence that is not being used by the translated intelligence and the outputs of the channels are combined as clear intelligence and bandwidth limited.

14 Claims, 5 Drawing Figures

SOUND SCRAMBLING EQUIPMENT

CROSS-REFERENCES TO RELATED APPLICATIONS

This application is a continuation-in-part of application Ser. No. 464,365 filed Apr. 26, 1974, now abandoned.

BACKGROUND OF THE INVENTION

1. Field of the Invention

This invention relates to improvements in communication secrecy systems and is particularly useful where the communication is over public communication channels.

Secrecy systems have been used for many years in military communications. Generally these systems are relatively complex and expensive. In recent time it has become desirable to have secrecy systems for law enforcement agencies and fire departments as well as other similar agencies employing public communication channels.

2. Description of the Prior Art

Secrecy systems that have been produced in the past have employed such techniques as static or rolling code band splitters to distort the voice signals to provide secrecy. Another technique that has been employed is the rearranging of the voice spectrum on a time basis. A common problem with these earlier attempts to provide secrecy in voice communications is that the system is relatively easy to break for recovery of the message. For example, in many systems employing the band spreading technique it has been found that if one band is recovered, sufficient intelligence is contained therein for recovery of the message. Similarly, if one time segment is correctly recovered with the time sharing technique, useable intelligence may be recovered. In these earlier systems the code can generally be broken without looking back at the circuitry used in scrambling the signal. Another approach that has been employed in the scrambling of the voice signals by mixing with a frequency modulated carrier frequency and the subsequent masking of the scrambled signal by application of a masking signal. However, in this system the masking signal may be removed by a simple filter in the decoding circuitry and the code broken thereafter. In addition to the problem of the codes being relatively easy to break, some of these earlier scrambling techniques have been limited to amplitude modulation communication systems and have not been useful in frequency modulated systems because of inter-modulation or cross-modulation caused by non-linearities in the communication system.

SUMMARY OF THE INVENTION

Improved secrecy communications is accomplished by the present invention by scrambling the intelligence within a known frequency spectrum by translating the frequency spectrum of the intelligence by mixing the signals within the frequency spectrum with a local oscillator signal having a frequency that varies between a plurality of discrete frequencies at a selected rate. The discrete frequencies of the local oscillator signal may be within a bandwidth as wide as the bandwidth of the frequency spectrum of the intelligence signals, and both bandwidths may be as wide as the bandwidth of the communication link. The translated frequency spectrum is passed through two or more channels with only the portion above a selected frequency being passed through a first channel. The portion that is passed through the first channel is reduced in frequency to have a frequency spectrum that is equal to or below the frequency spectrum at the lower end of the frequency spectrum of the unscrambled intelligence that is not being used by the translated intelligence. The portion that passes through the first channel may be placed below the unused frequency spectrum by a selected amount to provide a guard band for improved fidelity. The entire frequency spectrum of the translated intelligence passes through a second channel and the output of each channel is combined. The combined signals are bandwidth limited and transmitted over an appropriate communication link to be unscrambled and utilized.

The scrambled intelligence is readily adaptable to frequency modulation where many of the prior art techniques are not. Additionally, the method of scrambling provides a strong algorithm that makes the breaking of the code very difficult as compared to many of the prior art methods of scrambling.

The scrambled signal is unscrambled by translating the frequency spectrum of the scrambled signals by mixing the signals with a local oscillator signal having a frequency that varies between a plurality of discrete frequencies at a selected rate in synchronism with the local oscillator signal employed in scrambling the signals. The translated scrambled signals are passed through two or more channels with only the portion of the signals above a selected frequency passing through a first channel. The portion of scrambled intelligence passing through the first channel is reduced in frequency to have a frequency spectrum at the lower end of the frequency spectrum of the scrambled intelligence that is not being used by the translated intelligence. The entire frequency spectrum of translated intelligence is passed through a second channel. The outputs of the channels are combined to result in clear intelligence within the original bandwidth of the intelligence before being scrambled with a portion appearing outside this bandwidth. the clear intelligence is bandwidth limited to remove signals outside the original bandwidth.

The present invention also includes the circuitry for performing the method of scrambling and unscrambling effectively and efficiently. The secrecy system of the present invention comprises a first local oscillator signal source having different discrete frequencies at a selected rate and a mixer having the intelligence to be scrambled coupled to one input and the local oscillator signal coupled to a second input. The output of the mixer is passed through two or more channels. A first channel includes a high-pass filter for passing the portion of the signal above a selected frequency. The first channel further includes means for reducing the frequency of the frequency spectrum of the portion passed therethrough to a frequency spectrum at the lower end of the frequency spectrum of the unscrambled intelligence that is not being used by the output signal from the mixer. The system further includes means for combining the outputs of the channels and a band-pass filter to limit the bandwidth of the combined signals. The scrambled intelligence is coupled through a communication link to an unscrambler unit. The unscrambler unit comprises a local oscillator signal source, synchronized with the first local oscillator signal source in the scrambler unit. The unscrambler unit further includes a mixer having the scrambled intelligence coupled to one input and the local oscillator signal coupled to another input.

The output of the mixer is passed through two or more channels, one of which includes a high-pass filter and means for reducing the frequency of the signals passed therethrough to a frequency spectrum at the lower end of the frequency spectrum of the unscrambled intelligence that is not being used by the output signals from the mixer. The unscrambler unit further includes means for combining the signals passed through the channels and means for limiting the bandwidth of the combined signals. The secrecy system additionally includes means for synchronizing the local oscillator of the unscrambler unit with the local oscillator of the scrambler unit. The system advantageously includes in each unit means for changing the frequency of the local oscillator from one discrete frequency to another incrementally.

BRIEF DESCRIPTION OF THE DRAWINGS

The above, and other features and advantages of this invention may be understood more clearly and fully upon consideration of the following specification and drawings in which.

DESCRIPTION OF THE PREFERRED EMBODIMENT

Figure 1:
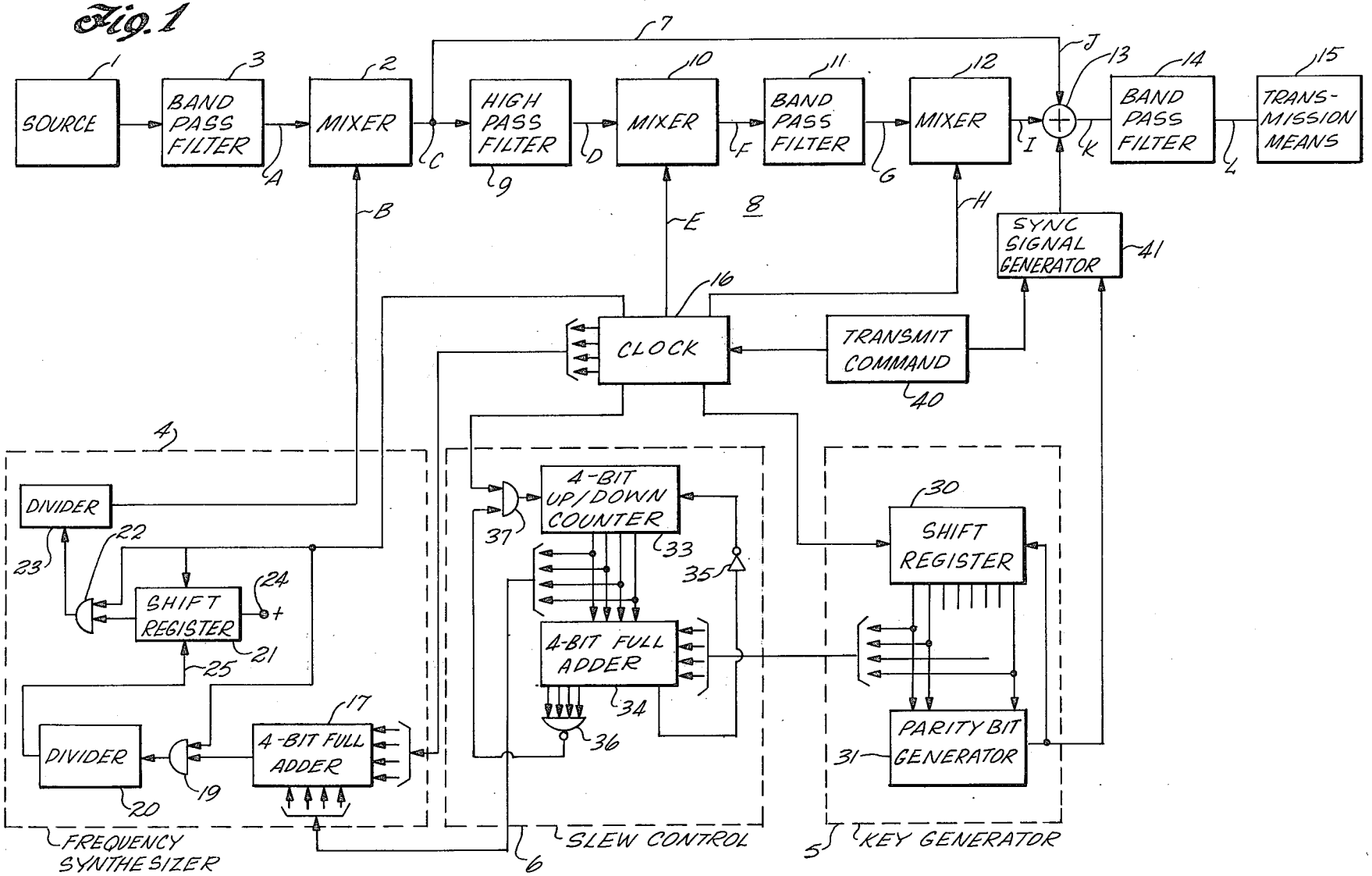
FIG. 1 is a block diagram of a scrambler unit in accordance with this invention.
Figure 2:
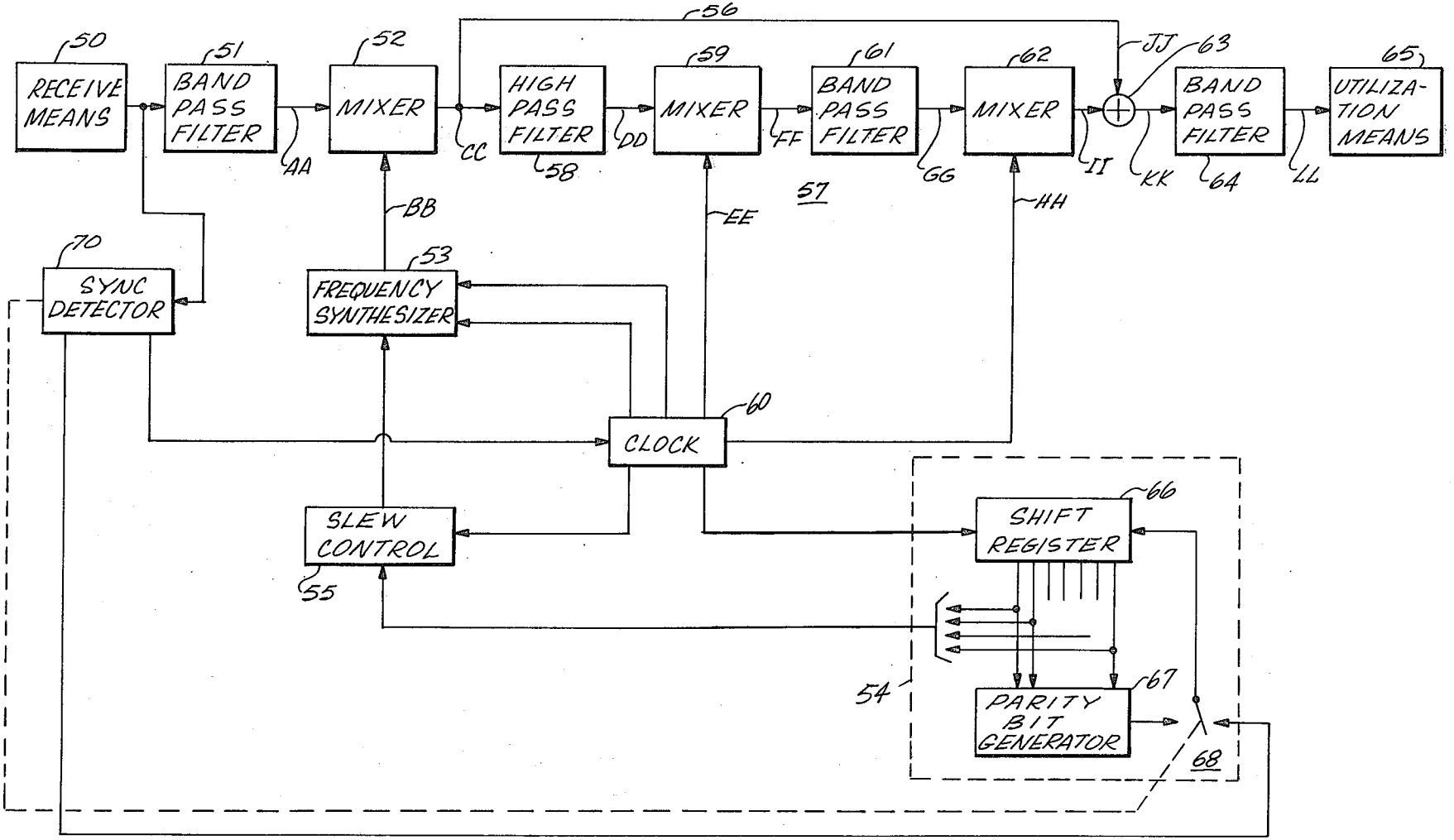
FIG. 2 is a block diagram of an unscrambler unit in accordance with this invention, FIG. 3 diagrammatically depicts the frequency spectrum of the signals appearing at various locations in the scrambler unit of FIG. 1 and is useful in understanding the present invention, FIG. 4 diagrammatically depicts the frequency spectrum at various locations in the unscrambler unit.

The secrecy system in accordance with this invention includes a scrambler unit shown in the block diagram of FIG. 1 and an unscrambling unit shown in the block diagram of FIG. 2. The scrambler and unscrambler units have many elements that may be identical and therefore a single unit may be constructed to operate as either a scrambler or an unscrambler with the other elements required for scrambling or unscrambling being switched in and out as necessary. For a single unit to be able to function as both, the unit would include in addition to the common elements, the elements that are unique to scrambling and the elements that are unique to unscrambling and means for switching these elements into the circuit depending upon the operation to be performed.

The scrambling of intelligence and in particular voice signals to provide secrecy in communication in accordance with this invention comprises the steps of translating the frequency spectrum of the intelligence by mixing the signals within the frequency spectrum with a local oscillator signal having a frequency that varies between a plurality of discrete frequencies at a selected rate. The bandwidth of the discrete frequencies may be as broad as the bandwidth of the intelligence to be scrambled. The translated frequency spectrum is passed through two or more channels and in at least one channel only the frequency spectrum above a selected frequency is passed. In this channel the portion of the translated intelligence that is passed is reduced in frequency so that the frequency spectrum thereof is moved to the lower end of the frequency spectrum of the unscrambled intelligence that is not being used by the translated intelligence. The outputs of the channels are combined and the bandwidth thereof is limited to a selected bandwidth.

A particularly advantageous circuit for performing this method of scrambling is shown in the block diagram of FIG. 1. A source 1 of intelligence, e.g., voice signals, to be scrambled is coupled to a mixer 2 through a band-pass filter 3. A local oscillator signal is coupled to input B of the mixer 2 and is provided by a frequency synthesizer 4 under the control of a key generator 5. The frequency synthesizer 4 changes frequency in steps or incrementally under the control of slew control unit 6, which is coupled between the key generator 5 and frequency synthesizer 4. The output of the mixer 2 is split into channels with the entire frequency spectrum thereof passing through a first channel 7. The output of the mixer 2 is also coupled to a second channel 8 which passes only a portion of the signals having a frequency above a selected frequency level. The second channel 8 includes a band-pass filter 9 for limiting the portion of the output signal from the mixer 2 that passes through this channel. The portion of the signals passed through channel 8 are applied to input D of mixer 10 which has a fixed frequency signal applied to an input E. The output of mixer 10 is limited by band-pass filter 11 and is applied to input G of mixer 12. A fixed frequency signal is applied to mixer 12 at H. The output of the channels are combined in a linear summer 13 and thereafter band limited by band-pass filter 14 coupled to the linear summer 13. A scrambled output at the output of band-pass filter 14 is coupled to a communication link through a transmission means 15.

The operation of the circuitry in the scrambler of FIG. 1 is under the control of a clock 16 that provides the timing signals for the generation of the local oscillator signal and also provides the fixed frequency signals for the mixers 10 and 12. The key generator 5, slew control unit 6 and frequency synthesizer 4 are digitally controlled by the clock 16. The frequency synthesizer 4 consists of a four bit full adder 17, dividers 20 and 23, shift register 21 and gates 19 and 22. The four bit full adder 17 has two sets of inputs, the first of which is connected to the output of the slew control unit 6. The second set of inputs to adder 17 is connected to the clock 16. The output of the full adder 17 is connected to AND gate 19 where it is combined with a fixed frequency output from clock 6 and is thereafter divided down in frequency by divider 20.

Shift register 21 has its input terminal 24 connected to a positive voltage or a logic one, its reset terminal 25 connected to the output of divider 20, and its clock input connected to the same fixed frequency output of clock 16 that is connected to AND gate 19. The output of the shift register 21 is combined with the fixed frequency signal of clock 16 in AND gate 22. The resulting output from AND gate 22 is divided down in frequency by divider 23. The output of divider 23 consists of two 90° phase quadrature signals which are applied to mixer 2.

A typical key generator useful in controlling the operation of the scrambler comprises a shift register 30 and a parity generator 31. The output of the shift register 30 is coupled to the parity generator 31 through a plurality of lines, the number of which is determined by the length of the shift register and the sequence of logical ones and zeroes desired from the key generator. Four of these lines provide a 4-bit output for control of the frequency synthesizer 4 through the operation of the slew control unit 6. The output of parity bit generator 31 is coupled to an input of shift register 30, which also has a timing pulse provided by clock 16. Slew control unit 6 comprises a 4-bit up-down counter 33 coupled to a 4-bit full adder 34. The 4-bit full adder has a 4-bit input from the key generator 5 and has an output coupled to the up-down counter through an inverter 35. Another output of the adder 34 is coupled through an AND gate 36 to one input of an AND gate 37. AND gate 37 has a second input from clock 16 and provides a timing signal input to the up-down counter 33. The output of the up-down counter 33 is coupled to the adder 34 and also provides a 4-bit input to the 4-bit adder 17 of the frequency synthesizer 4.

For unscrambling the scrambled output of the scrambler of FIG. 1 the unscrambler unit must be synchronized with the scrambler unit. For this purpose a transmit command element 40 is coupled to the clock 16 for zeroing the phase of the clock at the beginning of each scramble operation of the scrambler. The transmit command element 40 is also coupled to a sync signal generator 41 which couples the transmit command pulse to the unscrambler unit through the transmit means 15. In addition to the transmit command pulse that is coupled to the sync signal generator 41, the state of the key generator 5 at the time of the transmit command pulse is also coupled through the sync signal generator 41 to the unscrambler unit through the transmit means 15. The scrambled output is unscrambled in accordance with this invention by frequency tranlating the scrambled intelligence and passing the translated frequency spectrum through two or more channels. Only a portion of the frequency spectrum is passed through one channel and the portion that is passed through this channel is frequency translated to the lower end of the frequency spectrum of the scrambled input that is not being used by the translated scrambled input. The outputs of the channels are combined and limited in bandwidth and appear at the output of the unscrambler unit as the clear intelligence.

The method of unscrambling may be advantageously accomplished in accordance with this invention by the unscrambler unit shown in block form in FIG. 2. The scrambled intelligence is received from the transmitting unit by a receive means 50, which may for example, be a radio receiver or a receiver in a telephone communication link. The output of the receive means 50 is band limited by a band-pass filter 51 and coupled to input AA of a mixer 52. Mixer 52 has a second input BB from a frequency synthesizer 53. The frequency of the output signal from the frequency synthesizer 53 is controlled by a key generator 54 through a slew control unit 55. The output of the mixer at point CC is passed through two or more channels. The entire frequency spectrum is passed through channel 56 while the portion above a selected frequency level is passed through a second channel 57. The second channel 57 includes a high-pass filter 58 which passes the signals above the selected frequency level. The output of the high-pass filter 58 appearing at point DD is applied to a mixer 59 which has a fixed frequency input on input EE from a clock 60. The output of the mixer 59 is band limited by band-pass filter 61 which is coupled to input GG of mixer 62. Mixer 62 has a second input HH of a fixed frequency signal from clock 60. The output II of mixer 62 is combined in a linear summer 63 with the entire frequency spectrum that passes through channel 56. The combined signal is band limited by band-pass filter 64 and applied to a utilization means 65. The key generator 54 comprises a shift register 66 and a parity bit generator 67. The shift register 66 has a clock input from clock 60 and a second input from parity generator 67 through a switch 68. Switch 68 is a single throw, double pole switch having one fixed contact connected to the output of parity generator 67 and a second fixed contact connected to the output of a sync detector 70. The sync detector 70 is coupled to the output of receive means 50 for detection and utilization of the synchronization signals from the scrambler unit. Sync detector 70 has a second output coupled to clock 60 for establishing a zero phase of the clock 60 at the beginning of each unscrambling operation. Sync detector 70 has a third output electronically or mechanically coupled to the movable contact of switch 68 for closing the contact between the sync detector 70 and the shift register 66 at the beginning of each unscrambling operation.

The system shown in FIGS. 1 and 2 operates as follows: The intelligence to be scrambled is band limited by band-pass filter 3 and has a frequency spectrum as illustratively shown in diagram A of FIG. 3. For purposes of illustration, voice signals having a frequency spectrum of 300 hertz to 2750 hertz as the intelligence to be scrambled will be used herein. The source 1 may therefore be some sort of transducer such as a microphone and the bandwidth of the intelligence may be equal to the bandwidth of the communication link such as a telephone communication link.

Figure 3:
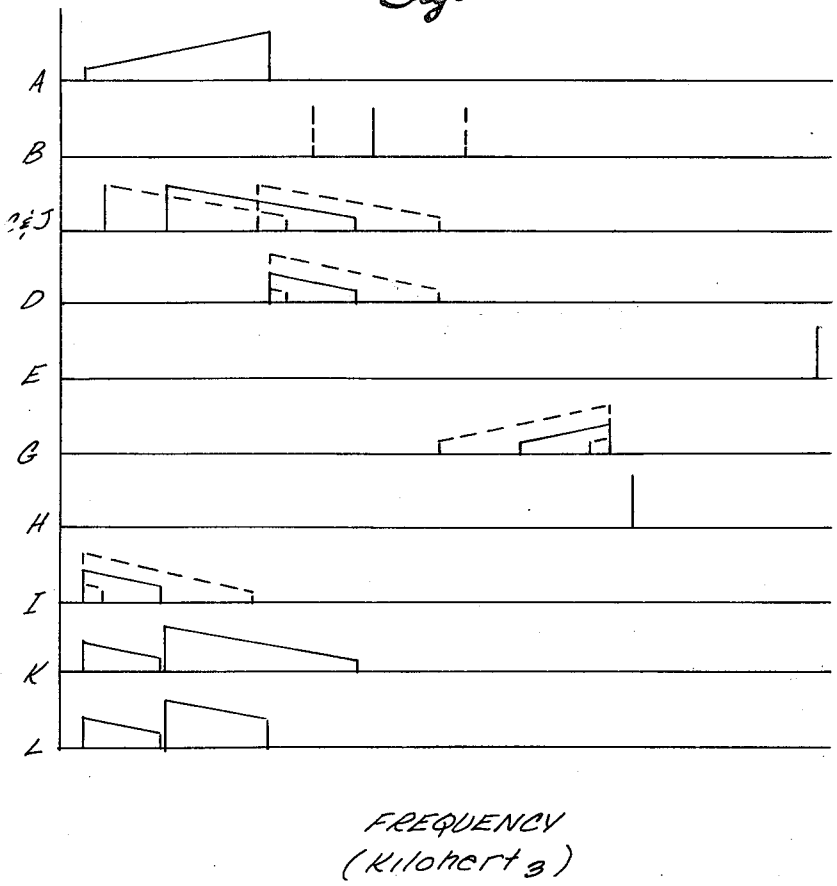

The intelligence appearing at point A is mixed with a local oscillator signal appearing at point B in mixer 2. Mixer 2 may be any of the typical types of mixers such as a suppressed carrier mixer. The local oscillator input signal at point B is illustratively shown in FIG. 3 and has a frequency that varies between discrete frequencies at a selected rate. For purposes of illustration a single frequency of 4125 hertz shown by the solid line in diagram B is selected in explaining the operation of the circuit. The local oscillator signal may have a discrete frequency within a frequency range that is as broad as the bandwidth of the intelligence to be scrambled. Thus, in this illustrative case the frequency range of the local oscillator signal may be 2450 hertz. In this illustrative example the local oscillator frequency varies between 3300 hertz and 5300 hertz as shown by the dotted lines on chart B. A 4125 hertz signal will translate the frequency spectrum of the intelligence from between 300 and 2750 hertz to a spectrum between 1375 and 3825 hertz. This is shown by the solid lines of diagram C and J of FIG. 3, which shows that the spectrum is inverted and translated. The frequency spectrum represented by curve C in FIG. 3 is the lower sideband of the output of the mixer 2. Since a double balanced single sideband mixer is employed, only the lower sideband is used in scrambling the intelligence in the circuitry of FIG. 1 and therefore this is the only sideband that is shown in FIG. 3. The frequency spectrum of the intelligence will be shifted lower or higher depending upon the frequency of the local oscillator signal which may be one of many discrete frequencies between 3300 and 5300 hertz.

The entire frequency spectrum or lower sideband at the output of mixer 2 is passed through channel 7. In channel 8 only that portion of the lower sideband above the cutoff frequency of the high-pass filter 9 will be passed. In this illustrative example the high-pass filter 9 has a cutoff frequency of 2750 hertz so that all signals having a frequency above 2750 hertz will be passed through channel 8. The portion of the frequency spectrum of the translated intelligence that passes through channel 8 is called herein a re-entrant band. The re-entrant band for a 4125 hertz local oscillator signal is shown by the solid lines of diagram D in FIG. 3. The re-entrant bands for the two frequency extremes of the local oscillator signal are shown in dotted lines in diagram D of FIG. 3. The portion of the frequency spectrum passed by filter 9 is inverted and frequency translated by a fixed frequency signal from clock 16 in mixer 10. The fixed frequency signal from clock 16 is at 10,000 hertz and shifts the re-entrant band to between 6175 and 7250 hertz, shown by the solid lines in diagram G. The output of mixer 10 is band limited by bandpass filter 11, and is applied to mixer 12. Mixer 12 has a fixed frequency input signal from clock 16 at 7520 hertz for inversion and translation of the re-entrant band to the lower end of the frequency spectrum of the unscrambled intelligence that is not being used by this translated spectrum. This is shown by diagram I in FIG. 3. The extremes of the re-entrant band for a local oscillator frequency variation between 3300 hertz and 5300 hertz are shown in dotted lines in diagram I of FIG. 3. The entire translated frequency spectrum passed by channel 7 and the re-entrant band translated in channel 8 are combined in the summer 13. The output of summer 13 at point K is shown in FIG. 3. The combined signal is band limited by bandpass filter 14 which limits the bandwidth to a width compatible with the communication link. With a telephone communication link, for example, the bandwidth would be between 300 and 2750 hertz. The diagram L in FIG. 3 as well as other solid line diagrams B, C, D, G, I and K represent the frequency spectrum of the signal at the various points in the scrambler unit for only one local oscillator frequency. As the local oscillator frequency varies between discrete values the frequency spectrum will also vary, consequently, the re-entrant band will be larger at times and smaller at other times. The local oscillator frequency varies at a selected rate between discrete frequencies and in conjunction with the re-entrant band channel provides a scrambled output that is relatively difficult to decode.

To minimize distortion caused by imperfect filter components a guard band is provided between the re-entrant band and the translated frequency spectrum. In this illustrative example the upper frequency of the re-entrant band is 1345 hertz while the lower frequency of the translated intelligence is 1375 hertz providing a guard band of 30 hertz. Broader or narrower guard bands can be provided by adjusting the frequency of the fixed frequency signals applied to mixers 10 and 12.

By the method of scrambling of this invention, the intelligence and the local oscillator signal can both have the bandwidth of the communication link. This allows any input frequency component to appear anywhere in the bandwidth of the link. It will be noted that the invention produces a high security level to the scrambled intelligence by virtue of the fact that the mixing process occurring in the mixer 2 is determined not solely by the frequency of the digital frequency synthesizer 4 but also by the manner in which it is programmed by the key generator 5. The shift register 30 and parity bit generator 31 form a psuedo random generator. The outputs of four of the stages of the shift register 30 are connected to the 4-bit adder 34 in slew control unit 6. Counter 33 in slew control unit 6 counts the input pulses from the adder 34 upwards or downwards depending on the state of its up-down control. The four output bits from counter 33 are connected to the full adder 34. The adder 34 produces the arithmetical sum of the 4-bit parity words generated by the shift register 30 and the counter 33. The output of adder 34 consists of a 4-bit sum and a 1-bit carry signal. The sum outputs of the adder 34 are connected to the 4-bit AND gate 36. The output of gate 36 is low only when the sum outputs from adder 34 are all high. At all other times the output of gate 36 is high. Since the output of AND gate 36 is connected as an input to AND gate 37, the clock pulses from clock 16 applied to AND gate 37 are continuously connected to the counter 33 except when the sum output of the adder produces all four high outputs. The carry output of the adder 34 is connected through the inverter 35 to counter 33. The operation of this circuit is such that clock pulses will be received by the counter 33 and will cause it to count up or down until the four sum outputs of the adder 34 are all set to high. The counter 33 will always be set after a series of clock pulses to the complement of the data word presented in shift register 30 to the adder 34.

Figure 5:
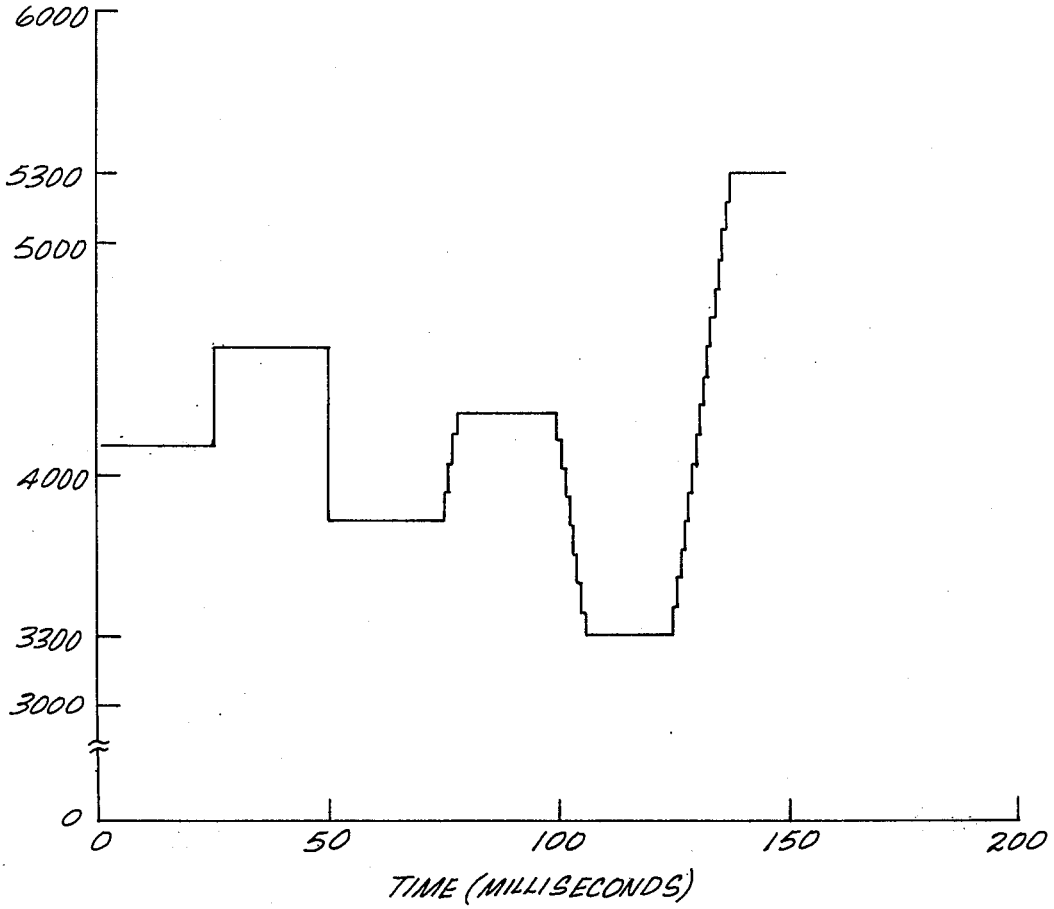
FIG. 5 is a diagram representing the change in frequency of the local oscillator in either the scrambler unit or unscrambler unit from one discrete frequency to another with a portion of the curve showing an abrupt change and another portion of the curve showing an incremental change from one discrete frequency to another in accordance with this invention.

When an abrupt change occurs in the shift register 30 output presented to the adder 34 the output of the counter 33 will change in steps or incrementally until it reaches the complement of the data word from the shift register. If the key generator 5 was coupled directly to the frequency synthesizer 4 the change in frequency of the synthesizer would be abrupt as depicted by the changes in frequency from 4125 hertz to 4550 hertz and from 4550 hertz to 3800 hertz shown in FIG. 5. However, with the slew control unit 6 connected between the key generator 5 and the synthesizer 4 changes from one discrete frequency to another in steps or in increments as shown in FIG. 5.

The frequency synthesizer 4 is designed to provide a linear distribution of frequencies as a function of the digital programming presented from the slew control unit 6. The output from the slew control unit 6 is added to four clock frequencies, that are generated by clock 16, in the full adder 17. For at least the frequencies of the illustrative example the clock inputs to the full adder 17 advantageously consist of 80, 160, 320, 640 kHz which results in an output from the full adder of N/16 pulses at an 80 kHz frame rate where N is the binary number that is entered from the slew control unit 6. The number of pulses coming from the full adder 17, which will vary from 0 to 15 at an 80 kHz frame rate, as determined by the key generator 5 via the slew control unit 6, is then doubled in gate 19 by combining the full adders output with a 1.28 mHz clock. The resulting output is then divided down in frequency by divider 20 the output of which is used to generate a subtraction pulse by means of shift register 21. The output of shift register 21 is low when the output of divider 20 is high and remains low for two 1.28 mHz clock pulses after the output from divider 20 goes low, after which it returns positive. This results in a subtraction pulse being applied to one input of gate 22 which will thus inhibit passage of the 1.28 mHz clock stream. This gated 1.28 mHz is then applied to divider 23 and is divided down in frequency to derive the proper output frequencies for use in mixer 2. The last two stages of divider 23 are connected so that two outputs are produced which have a constant ninety degree phase shift between them.

Prior to transmission of scrambled intelligence from the scrambler unit a transmit command signal is generated. This signal may be generated by closing a switch in transmit command element 40 to provide a signal to clock 16 and sync signal generator 41. The generated signal is transmitted to the receiver and unscrambler unit shown in FIG. 2 and is detected by the sync detector 70. The generator signal causes clock 16 to start at zero phase and clock 60 to start at zero phase in synchronism with the clock 16. Additionally, the transmit command signal causes the state of the key generator 5 at that time to be transmitted to the receiver and unscrambler unit shown in FIG. 2. The state of the key generator 5 is detected by the sync detector 70 which causes the switch 68 to close the circuit between the sync detector 70 and shift register 66 so that the state of the key generator 5 is loaded into the shift register 66 to initialize the key generator 54 of the unscrambler unit. Thereafter the frequency of the local oscillator signal in the unscrambler unit that is applied to mixer 52 will be the same as the frequency of the local oscillator signal applied to mixer 2 and will change frequency incrementally under the control of slew control 55 and key generator 54 in synchronism with the changes in frequency of the local oscillator signal in the scrambler unit.

Figure 4:
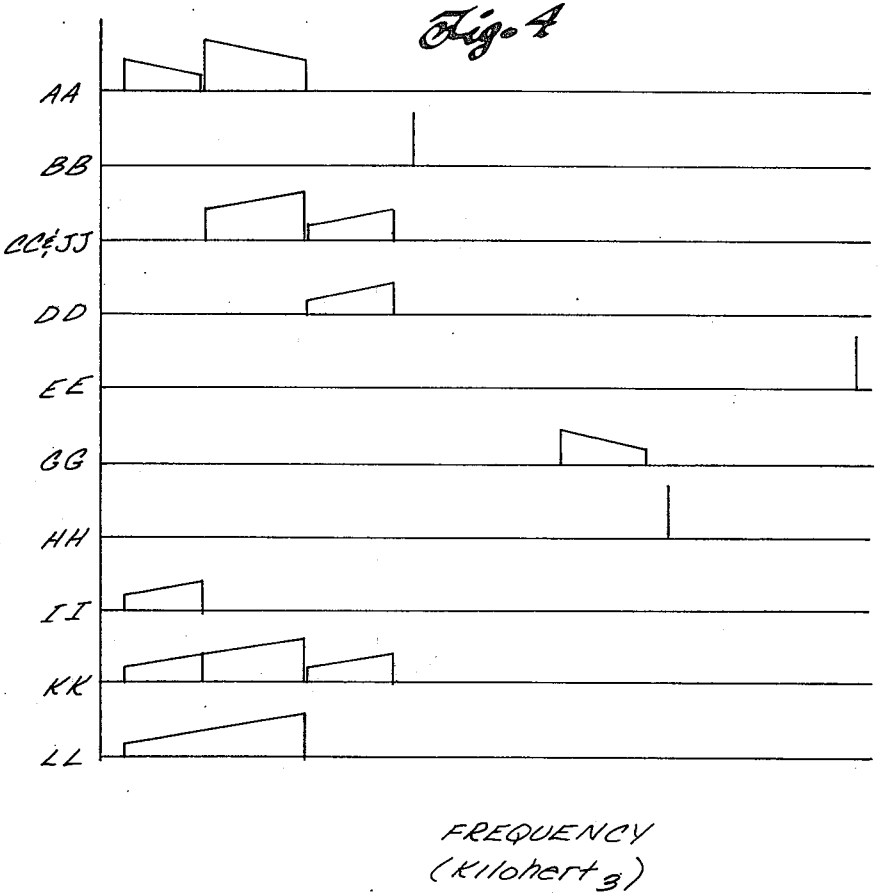

After synchronization has taken place the scrambled input signal represented by diagram AA of FIG. 4 is applied to mixer 52. A local oscillator signal represented by diagram BB at the output of frequency synthesizer 53 is also applied to mixer 52 to frequency translate the scrambled input as shown by diagram CC in FIG. 4. The entire frequency spectrum at the output of the mixer 52 is passed through channel 56 while only that portion above a selected frequency is passed through channel 57. The high-pass filter 58 has a cutoff frequency of 2750 hertz so that the portion of the scrambled input above this frequency is passed through channel 57. This portion of the scrambled intelligence is applied to mixer 59 which has a fixed frequency input of 10,000 hertz so that this portion of the scrambled intelligence is translated upwards in frequency. The output of mixer 59 is band limited by band-pass filter 61 and applied to mixer 62. A fixed frequency signal having a frequency of 7520 hertz is applied from clock 60 to produce the output represented by diagram II in FIG. 4. The output of mixer 62 and mixer 52 are combined in summer 63 to produce the signal diagrammatically shown by diagram KK in FIG. 4. The combined signal is band limited by band-pass filter 64 to produce a clear signal output as shown on diagram LL. The recovered intelligence is then applied to a utilization means 65.

Various modifications may be made in the details of the system without departing from the spirit and scope of this invention as defined by the appended claim.

We claim:

1. A method of scrambling intelligence within a known frequency spectrum comprising the steps of translating the frequency spectrum of the intelligence by mixing the signals within the known frequency spectrum with a local oscillator signal having a frequency that varies between a plurality of discrete frequencies within a selected band at a selected rate, passing only that portion of the translated frequency spectrum above a selected frequency through a first channel, translating the passed portion to a frequency spectrum at the lower end of the frequency spectrum of the unscrambled intelligence that is not being used by the intelligence translated by the local oscillator signal, passing through a second channel the entire frequency spectrum of the intelligence translated by the local oscillator signal, combining the output of each channel, and limiting the bandwidth of the combined signals to a selected bandwidth.

2. The method of scrambling in accordance with claim 1 comprising the further step of changing the frequency of the local oscillator signal from one discrete frequency to another in steps of equal frequency change per unit of time.

3. The method of scrambling in accordance with claim 1 wherein the frequency of the local oscillator signal varies randomly between the discrete frequencies in plural steps of equal frequency change per unit of time.

4. The method of scrambling in accordance with claim 1 wherein the discrete frequencies of the local oscillator signal are within a bandwidth no greater than the bandwidth of the frequency spectrum of the intelligence.

5. The method of scrambling in accordance with claim 1 wherein the frequency spectrum at the output of the first channel is below the unused frequency spectrum of the intelligence by a selected guard band.

6. The method of scrambling in accordance with claim 5 wherein the portion passed through the first channel is translated by first mixing the signals within the portion with a first fixed frequency local oscillator signal, band limiting the output, and mixing the band limited signal with a second fixed frequency signal having a frequency lower than the first fixed frequency signal by an amount equal to the bandwidth of the frequency spectrum of the intelligence plus the guard band.

7. A voice secrecy system comprising a first local oscillator signal source having a frequency that varies between a plurality of discrete frequencies at a selected rate, a mixer having a voice signal input coupled to a source of voice signals to be scrambled and a local oscillator signal input coupled to the first local oscillator source, a first channel for passing the lower sideband of the mixed signals, a second channel, means in the second channel for limiting the signal passed through the second channel to only the portion of the lower sideband above a selected frequency, means in the second channel for translating downward the frequency spectrum of the portion of the lower sideband in the second channel to a frequency spectrum below the lowest frequency of the lower sideband, means for combining the lower sideband passed through the first channel and the portion of the lower sideband passed through the second channel, and means for limiting the bandwidth of the combined signal to a selected bandwidth.

8. A voice secrecy system in accordance with claim 7 wherein the mixer is a single sideband mixer.

9. A voice secrecy system in accordance with claim 7 wherein the translating means in the second channel comprises a second local oscillator signal source, a second mixer having one signal input coupled to the limiting means and a second signal input coupled to the second local oscillator signal source, a band-pass filter coupled to the output of the second mixer for passing only the lower sideband of the output signal from the second mixer, a third mixer having one input terminal coupled to the output of the band-pass filter and a second input terminal coupled to a third local oscillator signal source, and a third local oscillator signal source having a fixed frequency below the frequency of the second local oscillator signal.

10. A voice secrecy system in accordance with claim 7 wherein the translating means in the second channel includes two mixers having fixed frequency inputs having a difference in frequency equal to the frequency by which the portion of the lower sideband at the output of the limiting means in the second channel is reduced in frequency.

11. A voice secrecy system in accordance with claim 7 further comprising means for changing the frequency of the first oscillator signal between the discrete frequencies in steps of a constant frequency change per unit of time.

12. A voice secrecy system in accordance with claim 7 wherein the first local oscillator signal source comprises a frequency synthesizer that changes frequency under the control of a key generator and a key generator that generates control signals that shift the frequency randomly.

13. A voice secrecy system in accordance with claim 12 further comprising circuit means between the frequency synthesizer and the key generator for changing the frequencies of the frequency synthesizer from one discrete frequency to another discrete frequency in steps of constant frequency change per unit of time.

14. A voice secrecy system comprising a scrambling unit and an unscrambling unit, the scrambling unit comprising a first local oscillator signal source having a frequency that varies between a plurality of discrete frequencies at a selected rate, a mixer having a voice signal input coupled to a source of voice signals to be scrambled and a local oscillator signal input coupled to the first local oscillator source, a first channel for passing the lower sideband of the mixed signals, a second channel, means in the second channel for limiting the signal passed through the second channel to only the portion of the lower sideband above a selected frequency, means in the second channel for translating downward the frequency spectrum of the portion of the lower sideband in the second channel to a frequency spectrum below the lowest frequency of the lower sideband, means for combining the lower sideband passed through the first channel and the portion of the lower sideband passed through the second channel, means for limiting the bandwidth of the combined signal to a selected bandwidth, means for controlling each change in frequency of the first local oscillator signal, means for generating a synchronization signal for synchronizing the timing in the scrambling unit and the timing in the unscrambling unit, and means for transmitting the control signal at the time of the synchronization signal from the scrambling unit to the unscrambling unit to initialize the control means in the unscrambling unit; the unscrambling unit comprising a third local oscillator signal source having the same discrete frequency in synchronism with the first local oscillator signal source, a mixer having an input terminal coupled to the scrambled voice signals and an input terminal coupled to the third local oscillator signal source, a first channel for passing the lower sideband output of the mixer; a second channel, means in the second channel for limiting the signal passed through the second channel to only the portion of the frequency spectrum of the lower sideband above a selected frequency, means in the second channel for translating downward the frequency of the portion of the lower sideband frequency spectrum in the second channel, means for combining the output of the first channel and the output of the second channel, and means for limiting the bandwidth of the combined signal to the bandwidth of the frequency spectrum of the voice signals that were scrambled.

* * * * *